US006519785B1

(12) United States Patent
Piercy, II

(10) Patent No.: US 6,519,785 B1
(45) Date of Patent: Feb. 18, 2003

(54) SANITARY PLUNGER DEVICE

(76) Inventor: Jerry H. Piercy, II, 101 Dry Gulley La., Surfside Beach, SC (US) 29575

( * ) Notice: Subject to any disclaimer, the term of this patent is extended or adjusted under 35 U.S.C. 154(b) by 0 days.

(21) Appl. No.: 10/021,359

(22) Filed: Nov. 30, 2001

(51) Int. Cl.[7] ..... E03D 11/00
(52) U.S. Cl. ..... 4/255.05; 4/255.11
(58) Field of Search ..... 4/255.01–255.12; 417/472; D32/35

(56) References Cited

U.S. PATENT DOCUMENTS

| | | | | | |
|---|---|---|---|---|---|
| 70,088 | A | * | 10/1867 | Hadfield | 4/255.1 |
| 3,336,604 | A | * | 8/1967 | Lacey et al. | 4/255.11 |
| 3,934,280 | A | | 1/1976 | Tancredi | |
| 3,952,341 | A | * | 4/1976 | Cain | 4/255.1 |
| 4,186,451 | A | | 2/1980 | Ruo | |
| 4,622,702 | A | * | 11/1986 | Allen | 4/255.12 |
| 4,847,923 | A | | 7/1989 | Huang | |
| 5,239,708 | A | | 8/1993 | Irwin | |
| 5,403,166 | A | | 4/1995 | Pingiotti | |
| 5,669,099 | A | | 9/1997 | Porcasi | |
| 5,762,482 | A | * | 6/1998 | Haraoka | |
| 6,032,301 | A | | 3/2000 | Wang | |
| 6,035,455 | A | | 3/2000 | Rankovic | |
| 6,067,668 | A | * | 5/2000 | Rudd | 4/255.11 |
| 6,145,135 | A | | 11/2000 | Pool et al. | |
| 6,192,525 | B1 | | 2/2001 | Tash | |
| 6,216,283 | B1 | * | 4/2001 | Tash | 4/255.11 |
| 6,241,091 | B1 | * | 6/2001 | Moore et al. | 4/255.11 |
| 6,247,190 | B1 | * | 6/2001 | Rigopoulus | 4/255.12 |
| 6,374,427 | B1 | * | 4/2002 | Tash | 4/255.11 |

* cited by examiner

*Primary Examiner*—Charles R. Eloshway
(74) *Attorney, Agent, or Firm*—Harleston Law Firm LLC; Kathleen M. Harleston

(57) ABSTRACT

An easy to use, sanitary plunger device for clearing drains includes: a one piece, generally bottle-shaped, hollow, curved body portion extending into a narrower neck portion ending in a generally circular opening, the opposite end of the plunger device being closed; the device being made of a flexible, sturdy, compressible material that returns to its shape following compression. A preferred embodiment of the plunger device includes a butterfly valve or a stem valve. A method of clearing clogged toilets or drains is also included. The plunger device serves to unstop a clogged toilet without the up and down motion and resultant splashing of filthy water associated with a conventional plunger.

18 Claims, 6 Drawing Sheets

SANITARY PLUNGER DEVICE

BACKGROUND OF THE INVENTION

1. Technical Field

The present device is a hand-operated, one-piece plunger device, which operates by forcing air instead of water into a clogged drain or toilet.

2. Background Information

When one's toilet is clogged, using currently available plungers often causes toilet water to splash out on the user. Some of them are overly complicated, and some are ineffective. Most work by forcing water down around the clog, which hopefully causes it to break up and/or move on down the drain. A need exists for a cleaner, more sanitary, simple device which effectively unclogs a drain line.

The present invention is an easy to use plunger device which forces air, not water, down to the clog in the drain line. When the present device is used, splashing is minimal and the user's hands do not come in contact with dirty toilet water. Using this plunger device is therefore believed to be more sanitary than using currently available plungers. The body of the present plunger device preferably includes grips, and not a central handle on the top of the device that must be pumped up and down. The present plunger device is one-piece, although it includes a small second piece, if it has a valve. The portable, hand-held plunger device of the present invention is for unclogging blocked drains in sinks, toilets, bath tubs, and the like.

BRIEF SUMMARY OF THE INVENTION

The present invention is a plunger device for unclogging blocked drains, comprising: a one piece, generally bottle-shaped, hollow main body with a generally circular opening in one end. The plunger device has a wider, curved body portion extending into a narrower neck portion. The neck portion ends in the opening to the hollow, while the opposite end of the plunger device is generally closed. The plunger device is substantially comprised of a flexible, sturdy, compressible material that returns to its general bottle shape following compression. The plunger device forces air into a toilet or other drain when the user squeezes the body of the bottle-shape, and refills itself with air when released through a preferred closable air valve at its closed end.

The plunger device serves to unstop a clogged toilet without the up and down motion, and resultant splashing of filthy water, associated with a conventional plunger. The device is simple and inexpensive to manufacture and operate, and provides a safe, effective, and sanitary means of unclogging drains. A method of clearing clogged toilets or drains is also included herein.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
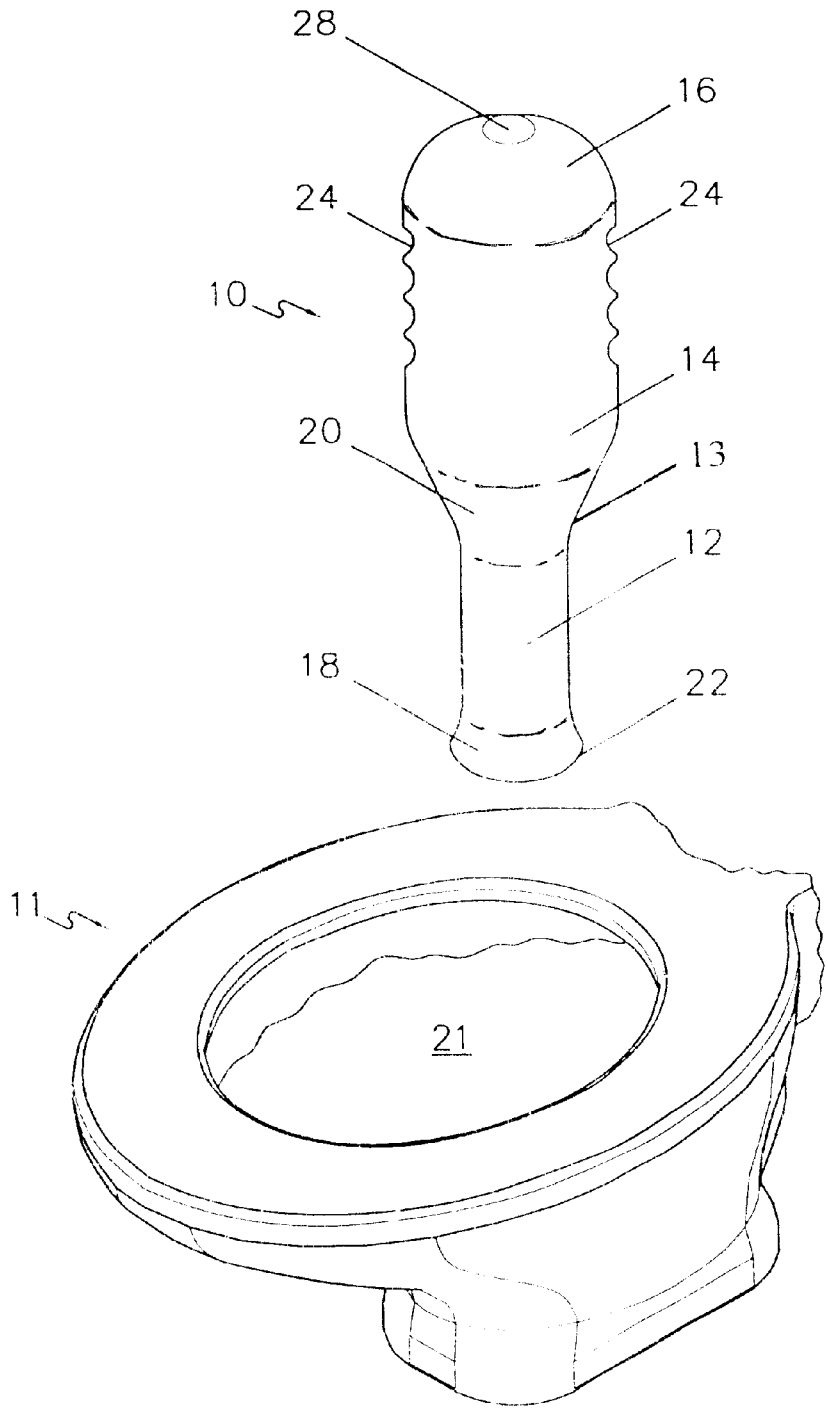
FIG. 1 is a perspective view of a plunger device according to the present invention.

In the following description, like reference characters designate like or corresponding parts throughout the several views. Also, in the following description, it is to be understood that such terms as "top," "bottom," "front," and the like are words of convenience and are not to be construed as limiting terms. Referring in more detail to the drawings, the invention will now be described.

Figure 2:
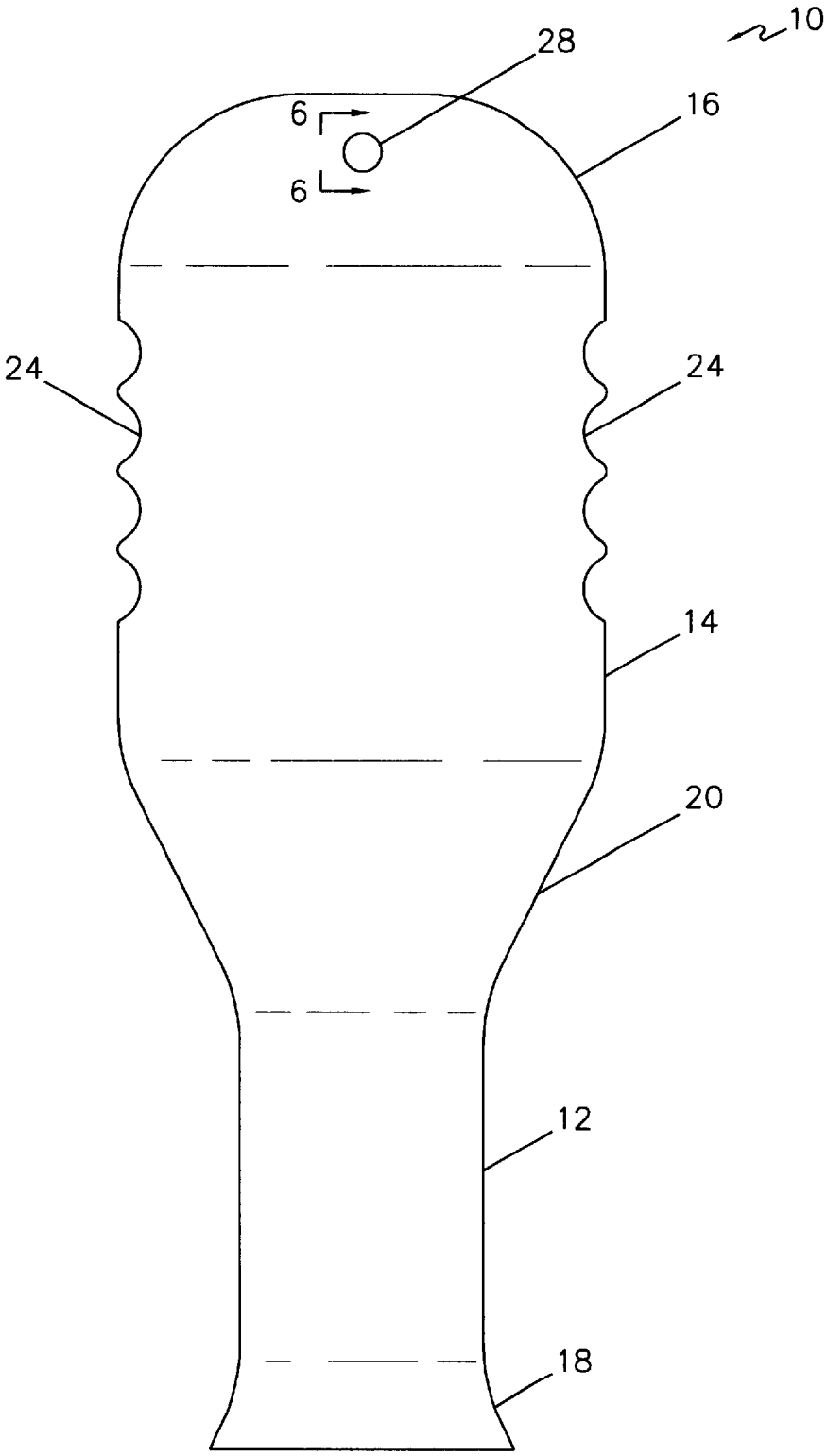
FIG. 2 is an elevational view of a plunger device according to FIG. 1.

Turning first to FIG. 1 and FIG. 2, a plunger device, generally referred to as 10, according to the present invention is shaped generally like an inverted bottle, with an elongated neck portion 12 and a closed, curved bottom end portion 16. The plunger device 10 has a one-piece, hollow main body 13 with a generally circular opening 15 in one end. The plunger device includes a wider body portion 14 extending into the narrower neck portion 12, which ends in the opening 15. The circular portion of the device around the opening is called here the lip 22. The opposite end portion 16 of the plunger device 10 is closed. The narrower neck portion 12 of the plunger device 10 widens into a pliable flange 18 at its lip 22, which is designed to fit snugly into the horn of a toilet 11, or over a drain. The neck portion 12 of the plunger device 10 is long enough so that when the plunger device 10 is placed into position in a toilet 11, the user's hands are not in or near the waterline. In this embodiment, the plunger device 10 has a series of finger grooves 24, or indentations, on the body portion 14.

The plunger device 10 is preferably not pleated, and does not require an elongate handle at the top for operation.

Figure 3:
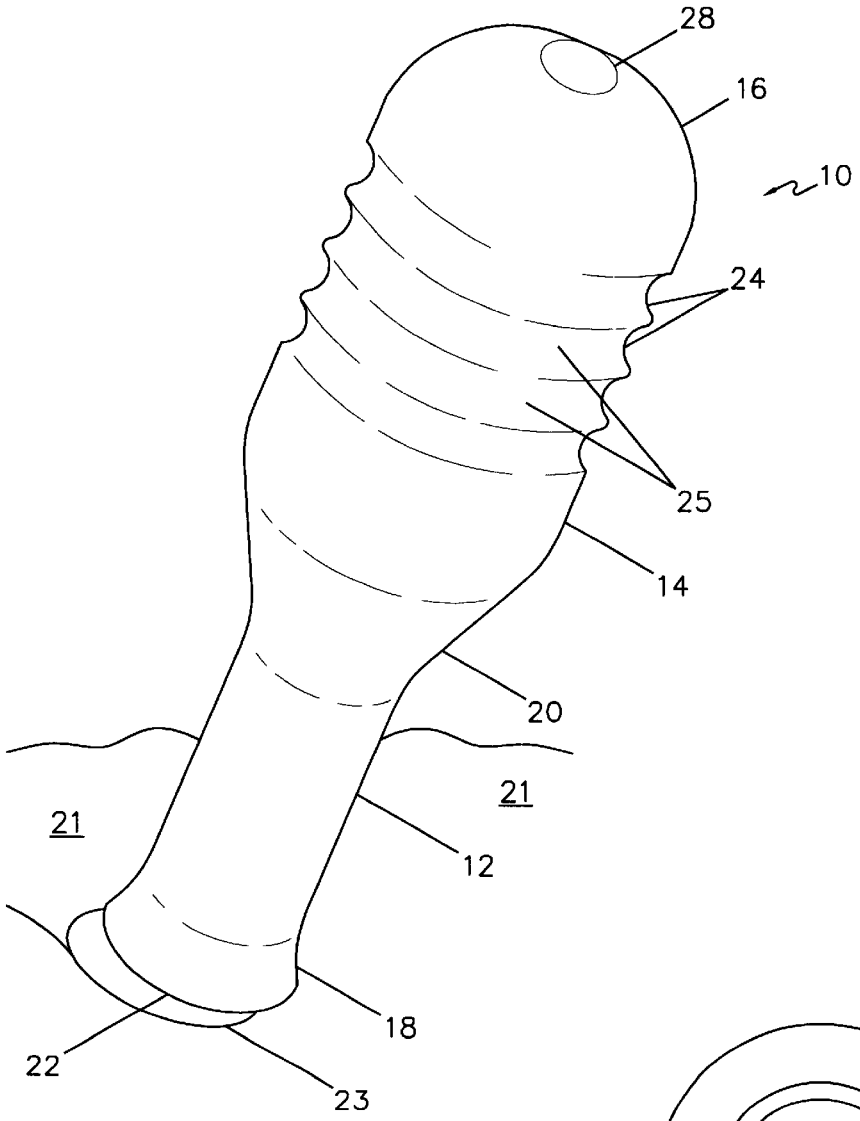
FIG. 3 is a perspective view of an alternate embodiment of a plunger device according to the present invention, shown in a toilet.

Referring to FIG. 3, to use the plunger device 10, the user grips it around its body 14 by means of the finger grooves 24 on opposite sides of the body portion. The finger groove indentations 25 can extend around the circumference of the body of the plunger device, as shown in FIG. 3, or they can be confined to the sides, as shown in FIG. 1. The plunger device may include three or four of the finger groove indentations 25 to guide placement of the user's hands when grasping the device 10. In FIG. 3, the plunger device is shown surrounded by toilet water 21. The plunger device 10 is tilted slightly and the lip 22 is inserted into the horn 23 of the toilet.

To use the plunger device 10, the user can stand in front of the toilet with both feet apart and grasp the sides of the plunger device 10 with both hands (in a choke-like hold). The user squeezes the plunger device 10, forcing air inside the plunger device 10 out through the mouth opening 15 into the toilet horn 23 and through the standing water down the drain, where the air likely dislodges the material causing the clog. As the clog breaks up and/or moves away down the drain pipe, any waste inside the toilet or the plunger device is expelled down the drain. The user then removes the plunger device from the toilet or drain. If the problem is not resolved, the user can reinsert the plunger device and repeat this action.

In another embodiment, the plunger 10 may be constructed as shown in FIG. 1 and FIG. 2, but without finger grooves 24, and the user simply grips the plunger around its body 14 and squeezes as described above.

The plunger device 10 is made of a flexible, sturdy, compressible material that returns to its shape following compression, and can easily be washed. A durable rubber or plastic material that is both flexible, allowing the user to squeeze the plunger without undue difficulty, and resilient, causing the plunger device 10 to readily resume its original shape when released, is a suitable material. A polyethylene or thermoplastic base material is most preferred. The material making up the lip 22 and neck portion 12 especially must be sufficiently flexible to fit into and block the toilet horn and durable enough to last for several years of erratic usage. Because the plunger device 10 works by injecting air into the drain, forced by alternately squeezing and releasing the plunger device 10, the physical up and down motion associated with conventional plungers is not present. Thus, the splashing of dirty water from the toilet or other clogged drain does not occur and, as a result, the plunger operates in a more sanitary and convenient manner than a conventional plunger. Also, the handles are above the level of water in the toilet, so the user need never touch the toilet water.

Continuing with FIGS. 1 through 3, the neck portion 12 of the plunger device 10 is preferably longer than the toilet water is deep. Since a conventional toilet bowl holds about three or four gallons of water, the toilet water is about six to eight inches deep at its deepest point. In a preferred embodiment, the neck portion 12 of the device is therefore between about six and eight inches in length, and the plunger device itself is about twice that length, or between about 12 and 18 inches long. The newer, water-conserving toilets generally utilize about half as much water to flush as a conventional toilet; usually about one or two gallons, so the neck portion of future plunger devices will preferably be between about three and four inches long, with the length of the plunger device being about twice that length, or between about eight and 12 inches. Since the present plunger surprisingly works because of air rather than toilet water, another important factor, in addition to the length of the plunger device 10, is the volume of air the device is capable of holding. There must be enough air inside the plunger device to force out the clog when the user forces the air from the device 10 into the drain. The interior 17 of the device is hollow, and it is capable of holding about two or three gallons of fluid. The plunger device 10 is preferably between about three and eight inches in diameter in order to hold the necessary volume of air.

Figure 4:
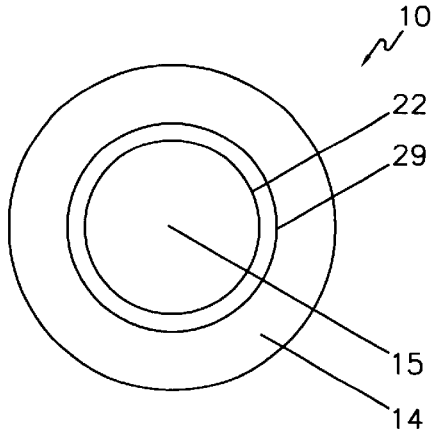
FIG. 4 is a bottom plan view of a plunger device according to the present invention.

Referring to FIG. 4, the mouth opening 15 leads into the hollow interior 17 of the plunger device 10, as can be seen in this plan view of the plunger device 10. The inside diameter of the main opening 15 is preferably between about one and four inches, so that it fits into an average-sized toilet horn, and/or over average-sized drain rings. The outside diameter of the lip 22, then, is approximately the same as the inside diameter of a horn of a conventional toilet. The diameter of the body 14, seen behind the lip 22 in FIG. 4, is about three or four times the diameter of the opening 15. The lip 22 and neck portion 14 are surprisingly narrow so that less water is displaced when the plunger device 10 is inserted in the toilet bowl. This means that toilet water is unlikely to be sloshed outside the toilet. Most of the air volume is contained in the hollow of the wider body portion 14.

In the embodiment shown in FIG. 4, the lip 22 includes a soft, flexible flap 29 which extends into the opening 15 from around the circumference of the lip 22. When the user forces the air out from the through the lip/drain connection. When the plunger device 10 is placed over the drain, this flap 29 forms a close temporary attachment to the drain ring, which helps to intensify suction between the lip 22 and the drain ring, especially when water or other fluid is present in the area. The flap 29 is preferably thinner than the walls of the device for a better seal. It is preferred that the lip not curl under sharply, so there is no edge there which could foster bacterial growth.

Figure 5:
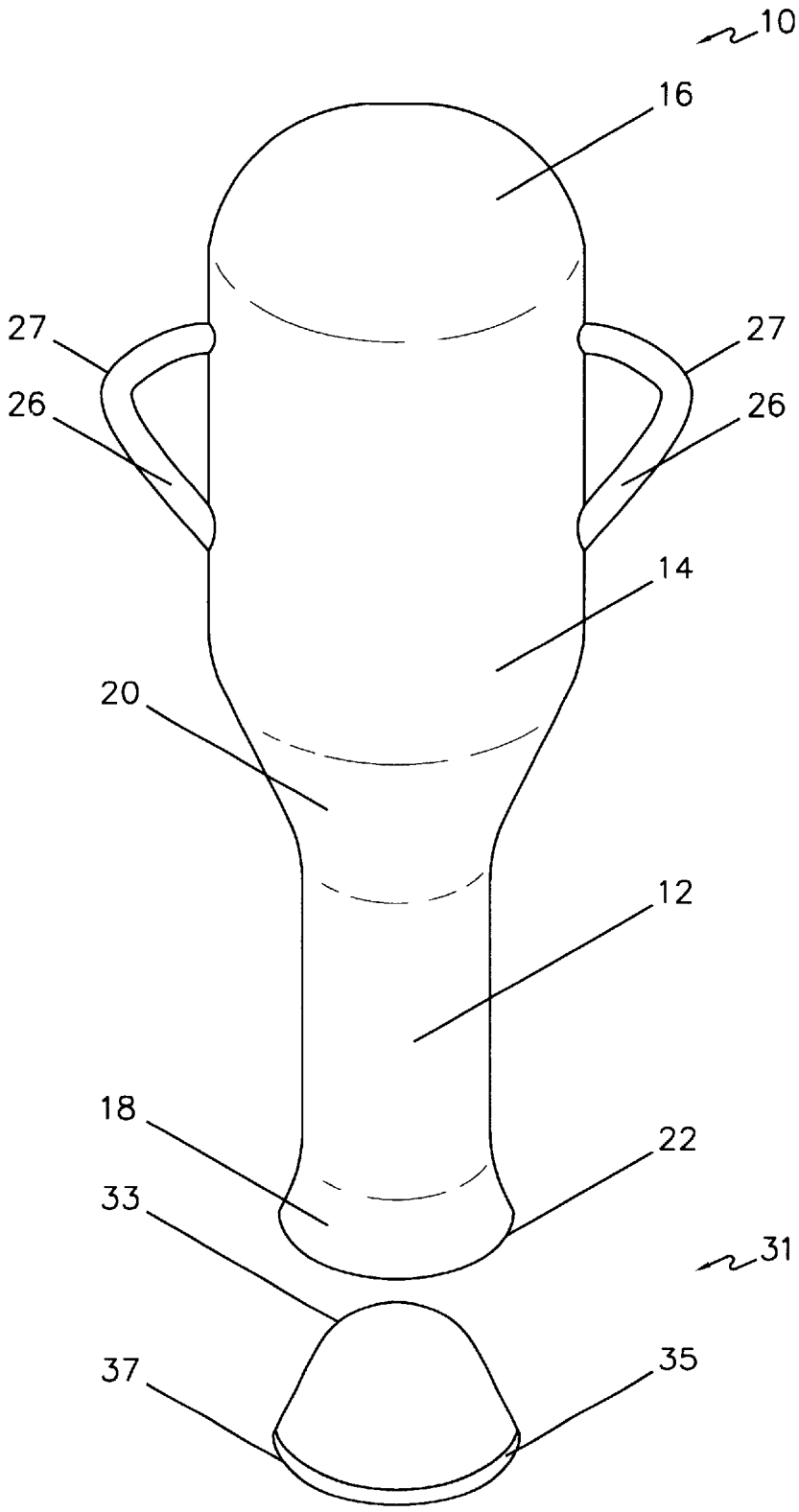
FIG. 5 is a perspective view of an alternate embodiment of a plunger device according to the present invention.

In an alternate embodiment illustrated in FIG. 5, the plunger device 10 is equipped with a set of handles 26 extending outwardly on the sides of its body 14, rather than finger grooves 24. These handles 26 may have thickened edges 27 to facilitate grasping, so that they resemble ears, as shown in FIG. 5. Alternatively, the handles may have apertures at their centers so they resemble vase handles, or they may have the form of any other suitable projection. The exterior of the plunger device may be decorated so that it resembles an animal, or a cartoon or other figure. The plunger device can also include colorizing or odorizing means, preferably located at the closed end of the device, with the color being coordinated with the scent emitted, to make the plunger device even more aesthetically pleasing. For example, a forest glade odor can be impregnated into the thermoplastic material of a green colored plunger device.

The purpose of the handles is to allow a pulling motion in addition to the squeezing motion. By gripping and pulling the handles 26, the user first expands the plunger device 10, pulling additional air inside through an air valve, preferably a butterfly valve 28 on the closed end portion 16 of the device, thereby increasing the inside air pressure and increasing the force directed into the drain when the user then squeezes the plunger 10.

The closed end portion 16 of the plunger device 10 may be flattened, as shown in FIG. 5. It is preferred, though, that the plunger device not have sharp corners on the inside in which residual contaminated water can collect, unbeknown to its owner, when the device is not in use.

When the user finishes with the lightweight plunger device 10, it can be stored right side up or upside down, as shown in FIG. 2, so that it can drain. The device 10 can be placed on a pedestal 31 for storage, as shown in FIG. 5, or it can be cleaned and dried and stored in a closet or under a sink. In contrast with many conventional plungers, this plunger device 10 fits neatly under the sink or on a shelf. The one piece pedestal 31 shown in FIG. 5 is preferably made of the same material as the plunger device 10; most preferably a thermoplastic base material. The opening 15 of the plunger device fits over the bullet-shaped nose portion 33 of the pedestal, which allows the plunger device 10 to drain after it has been washed. The pedestal 31 has a wide, circular base 35 so that it does not tip over when the plunger device 10 is in place on the pedestal. The bottom of the base 35 is slightly wider than the diameter of the opening 15 of the device 10, so the lip 22 is held off the (bathroom) floor or shelf on which the pedestal 31 rests. The bottom of the pedestal is flat, and the bottom edges 37 of the pedestal optionally curve slightly upward, forming a circular channel, so that any water dripping off the plunger device does not drip onto the floor. The diameter of the bullet-shaped nose portion 33 is slightly smaller than the inside diameter of the device's opening 15, with the diameter of the pedestal gradually increasing to the bottom of the base 35. The bullet shaped nose portion 33 is insertable in the opening of the plunger device 10. This pedestal is ideal because it supports the plunger device in an upright (vertical) position, yet does not take up a lot of room in the cabinet or on the floor. Alternatively, the pedestal 31 can be inserted in the device's opening 15 like a cover, and the plunger device can be stored upright or on its side.

Since the plunger device 10 is basically molded in one piece, it is easy to wash and store. No assemblage is necessary to use the plunger device. Another benefit of the plunger device being one piece is that air does not seep through seams in the device, as often happens over time with some plastic devices. The one piece plunger device dries easily and has few seams or ledges where dirty water can collect and foster bacterial growth. Bacteria are unlikely to grow on the smooth, dry surface of the plunger device of the present invention, in comparison with a more complicated device.

Figure 6:
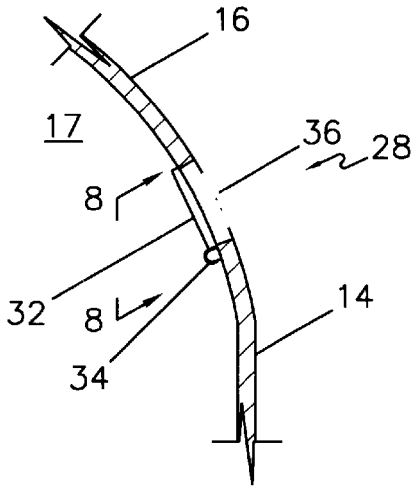
FIG. 6 is a sectional view of a portion of a plunger device according to FIG. 2, taken at line 6—6, showing a butterfly valve in a closed position.
Figure 7:
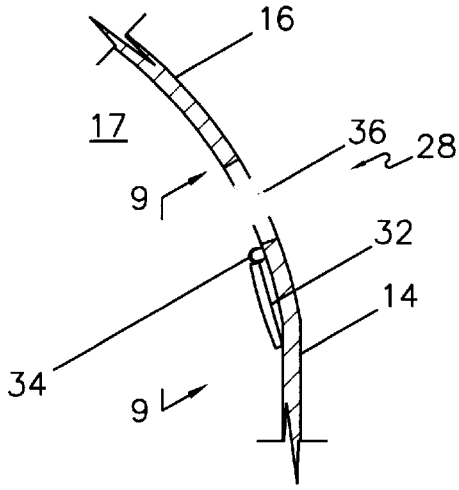
FIG. 7 is a sectional view of a portion of a plunger device according to the present invention, showing a butterfly valve in an open position.
Figure 8:
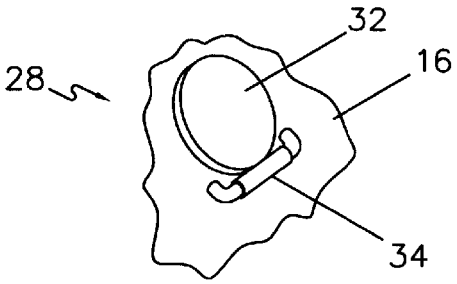
FIG. 8 is a perspective view of a closed butterfly valve according to FIG. 6, taken at line 8—8.

Referring to FIG. 2 and FIGS. 6 through 9, in the preferred embodiment shown, the plunger device 10 includes a butterfly valve 28 in the curved, closed end portion 16, which is at the top of the device when the device 10 is positioned for use in a toilet 11 or over a drain. In the preferred embodiment, the butterfly valve 28 is located approximately at the center of the closed end portion 16, although the exact position is not controlling of the function. Of course, the valve 28 is preferably on the opposite end of the device than the main opening 15 so that it is not covered by toilet water. Referring to FIG. 6 and FIG. 8, which show the valve 28 in a closed position, the valve cover 32 covers the valve opening 36 to the hollow interior 17 of the device when the valve 28 is closed. Since the valve cover 32 preferably opens to the inside of the device, the valve 28 prevents air from being expelled through the top, or the closed end portion 16, when the user squeezes the plunger device 10, and thus forcing air out through the other, open end 22 into the drain.

Figure 9:
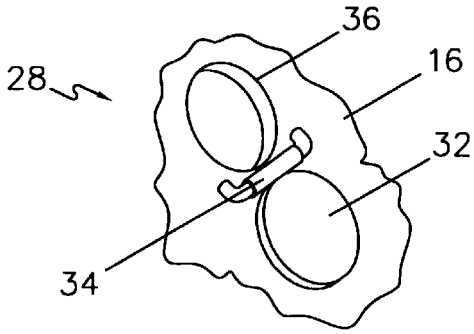
FIG. 9 is a perspective view of an open butterfly valve device according to FIG. 7, taken at line 9—9.

Turning to FIG. 7 and FIG. 9, which show the butterfly valve 28 in an open position, when the user releases his or her grip on the plunger device 10, the device, being made of a resilient material, will resume its normal shape. This will result in lower pressure inside the plunger device 10, which pulls the valve cover 32 inside, opening the valve 28 and refilling the plunger device 10 with air instead of sucking only water into the plunger device 10 through the opening 15 at the other end. The valve cover 32 is shown connected to the plunger device 10 by means of a valve hinge 34 on the inside; however, other means of connection will serve equally as well as long as the valve cover 32 is free to swing open or closed.

Figure 10:
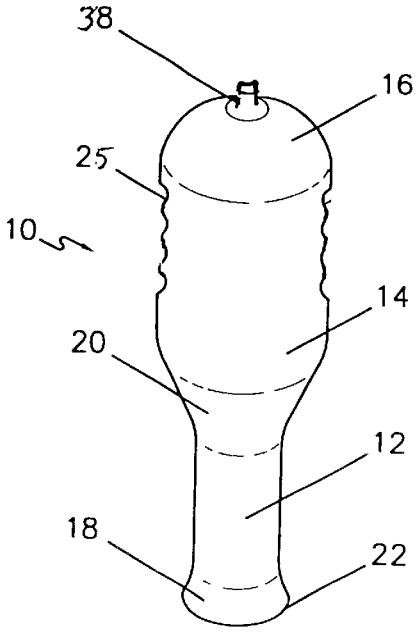
FIG. 10 is a perspective view of an alternate embodiment of a plunger device according to the present invention, showing a stem valve in a closed position.
Figure 11:
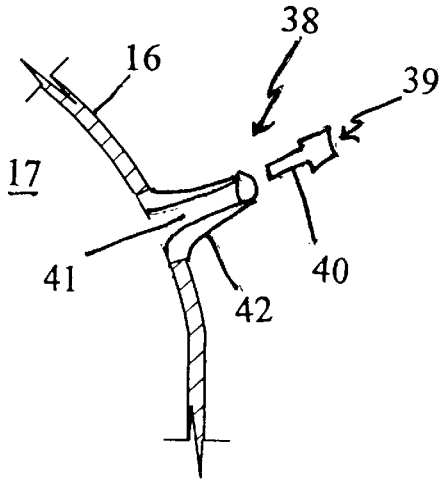
FIG. 11 is a sectional view of a portion of a plunger device according to FIG. 10, taken at line 11—11, showing a stem valve in an open position.

Referring to FIGS. 10 and 11, an alternate embodiment of a plunger device 10 shows a stem valve 38 in a closed position in FIG. 10. A cross-section of the stem valve 38 in an open position is shown in FIG. 11. The stem valve is preferably located on the closed end portion 16 of the plunger device 10. In the present invention, the stem valve 38 has a central opening 41, which leads into the hollow interior 17 of the plunger device (see FIG. 11). The valve is ordinarily closed by a removable threaded cap 39. The stem valve cap 39 includes a lower plug portion 40, which fits into and blocks the hole 41 in the stem valve. The threaded cap 39 screws onto corresponding threading at the upper end of the stem 42.

To use the plunger device, the user places the plunger device 10 into the horn of the toilet and squeezes the device, as described above. Once toilet water has entered the plunger device 10, the user unscrews the stem valve cap 39, permitting air to enter the interior of the plunger device through the hole 41 in the stem valve 38 (see FIG. 11). This causes the contents of the plunger device to drain back into the toilet. The plunger device is then removed from the toilet and the toilet can be flushed. The plunger device can then be washed, and the stem valve cap 39 is screwed back onto the stem 42.

One advantage of including a valve in the present invention is that toilet water is unlikely to overflow the toilet. This is a definite benefit where, as is often the case in a clogged toilet, the toilet is close to overflowing. The tendency of the plunger device to suck water back inside it is an intended feature to help unclog the drain. Another advantage is that unattractive, unhealthy contaminated toilet water does not remain inside the plunger device when the plunger device is removed from the toilet bowl.

Also included in the present invention is a method for unclogging a toilet or drain pipe, comprising the steps of:

(a) placing a circular opening 15 of a one piece, generally bottle-shaped, hollow plunger device 10 made of a flexible, sturdy, washable, compressible, resilient material, over a horn 23 of the toilet, or the opening of a drain pipe; and (b) squeezing the plunger device 10 tightly one time. Where the plunger device does not include a valve, the method preferably further includes the steps of:

(c) removing the plunger device 10 from the toilet;

(d) allowing toilet water to drain off; and (e) repeating steps (a) and (b).

Where the plunger device 10 includes a butterfly valve 28, the method further includes the steps of:

(c) releasing compression on the plunger device 10, allowing air to be sucked into the plunger device 10 through a butterfly valve 28 in the closed end portion 16 of the plunger device; and (d) squeezing the plunger device 10 again, causing the butterfly valve 28 to close.

Where the plunger device 10 includes handles 26 and a butterfly valve 28, the method preferably further comprises the steps of:

(c) pulling handles 26 on opposite sides of the plunger device 10, thereby expanding the volume of air in the plunger device, and pulling air in through a butterfly valve 28 in the closed end portion 16 of the plunger device, and increasing the volume of air available to be forced down into the drain; and (d) squeezing the plunger device 10 again, causing the butterfly valve 28 to close.

Where the plunger device 10 includes a stem valve 38, the method further includes the steps of:

(c) unscrewing a threaded cap 39 of a stem valve 38 in the closed end portion 16 of the plunger device 10, permitting air to enter the plunger device through the stem valve;

(d) allowing the contents of the plunger device 10 to drain into the toilet; and (e) removing the plunger device 10 from the toilet.

From the foregoing it can be realized that the described device of the present invention may be easily and conveniently utilized as a means of unclogging blocked drains. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 plunger device
11 toilet
12 neck portion
13 main body
14 body portion
15 opening
16 closed end portion
17 hollow interior
18 flange portion
20 shoulder portion
21 toilet water
22 lip
23 toilet horn
24 finger grooves
25 finger groove indentations
26 handles
27 handle edge
28 butterfly valve
29 flap
31 pedestal
32 valve cover
33 nose portion of pedestal
34 valve hinge
35 base portion of pedestal
36 valve opening
37 bottom edge of pedestal
38 stem valve
39 stem valve cap
40 stem valve plug portion
41 stem valve hole
42 stem

What is claimed is:

1. A plunger device for clearing drains, comprising: a one piece, generally bottle-shaped, hollow main body with a generally circular opening to the hollow in one end, the plunger device comprising a curved body portion extending into a narrower neck portion, the neck portion ending in the circular opening, the opposite end of the plunger device being generally closed; the plunger device being substantially comprised of a flexible, sturdy, compressible material that returns to its general bottle shape following compression; the plunger device further comprising a detachable, portable pedestal comprising a bullet-shaped upper nose portion and a circular base portion; the base portion having a diameter that is greater than the diameter of the opening of the plunger device; the bullet-shaped nose portion of the pedestal having a diameter that is smaller than the inside diameter of the plunger device's opening, with the diameter of the pedestal gradually increasing to the bottom of the base portion; the bullet shaped nose portion being insertable in the opening of the plunger device.

2. A plunger device according to claim 1, further comprising a closable air valve in the closed end portion of the plunger device.

3. A plunger device according to claim 2, wherein the compressible material is a polyethylene material.

4. A plunger device according to claim 2, further comprising finger grooves on the body portion.

5. A plunger device according to claim 4, in which the valve is a butterfly valve on the inside of the closed end portion of the plunger device.

6. A plunger device according to claim 5, further comprising a sloping shoulder portion between the body portion and the neck portion.

7. A plunger device according to claim 2, further comprising handles projecting from opposite sides of the body portion of the plunger device.

8. A plunger device according to claim 2, wherein the compressible material is a thermoplastic base material.

9. A plunger device according to claim 2, further comprising a flexible flap extending inward around the circumference of the opening.

10. A plunger device according to claim 2, wherein the length of the neck portion is between about one half and one third the length of the plunger device, and the diameter of the plunger device is between about one half and one third the length of the plunger device.

11. A plunger device according to claim 10, in which the valve is a stem valve having a central opening to the hollow interior of the plunger device, and a removable threaded cap.

12. A plunger device according to claim 10, wherein the end of the neck portion flares outward into a flange portion ending in a circular lip around the opening.

13. A plunger device according to claim 12, further comprising colorizing or odorizing means.

14. A plunger device for clearing drains, comprising:

(a) a one piece, generally bottle-shaped, hollow main body with a generally circular opening to the hollow in one end, the plunger device comprising a curved body portion extending into a narrower neck portion, the neck portion ending in the circular opening, the opposite end of the plunger device being generally closed; the plunger device being substantially comprised of a flexible, sturdy, compressible material that returns to its general bottle shape following compression;

(b) a detachable, portable pedestal comprising a bullet-shaped upper nose portion and a circular base portion; the base portion having a diameter that is greater than the diameter of the opening of the plunger device, the bullet-shaped nose portion of the pedestal having a diameter that is smaller tan the inside diameter of the plunger device's opening, with the diameter of the pedestal gradually increasing to the bottom of the base portion; the bullet shaped nose portion being insertable in the opening of the plunger device;

(c) colorizing or odorizing means; and (d) a closable air valve in the closed end portion of the plunger device;

wherein the length of the neck portion is between about one half and one third the length of the plunger device, and the diameter of the plunger device is between about one half and one third the length of the plunger device; and wherein the end of the neck portion flares outward into a flange portion ending in a circular lip around the opening.

15. A method for unclogging a toilet or drain pipe, comprising the steps of:

(a) placing a circular opening of a one piece, generally bottle-shaped, hollow plunger device made of a flexible, sturdy, compressible, resilient material, over a horn of the toilet, or the opening of a drain pipe;

(b) squeezing the plunger device forcibly;

(c) pulling handles on opposite sides of the plunger device, thereby expanding the volume of air in the plunger device, and pulling air in through a butterfly valve in the closed end portion of the plunger device; and (d) squeezing the plunger device again, causing the butterfly valve to close.

16. A method according to claim 15, further comprising the steps of:

(e) removing the plunger device from the toilet;

(f) allowing toilet water to drain off; and (g) repeating steps (a) and (b).

17. A method according to claim 15, further comprising the steps of:

(e) releasing the compression on the plunger device, allowing air to be sucked into the plunger device through a butterfly valve in the closed end portion of the plunger device; and (f) squeezing the plunger device again, causing the butterfly valve to close.

18. A method for unclogging a toilet or drain pipe, comprising the steps of:

(a) placing a circular opening of a one piece, generally bottle-shaped, hollow plunger device made of a flexible, sturdy, compressible, resilient material, over a horn of the toilet or the opening of a drain pipe;

(b) squeezing the plunger device forcibly;

(c) unscrewing a threaded cap of a stem valve in the closed end portion of the plunger device, permitting air to enter the plunger device through the stem valve;

(d) allowing the contents of the plunger device to drain into the toilet; and (e) removing the plunger device from the toilet.

* * * * *